US007496326B2

(12) United States Patent
Kawabata

(10) Patent No.: US 7,496,326 B2
(45) Date of Patent: Feb. 24, 2009

(54) ELECTROSTATIC ATTRACTION DEVICE AND IMAGE FORMING APPARATUS USING THE SAME

(75) Inventor: Kenichi Kawabata, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 489 days.

(21) Appl. No.: 11/303,794

(22) Filed: Dec. 15, 2005

(65) Prior Publication Data

US 2006/0132574 A1 Jun. 22, 2006

(30) Foreign Application Priority Data

Dec. 22, 2004 (JP) ..... 2004-370561
Feb. 16, 2005 (JP) ..... 2005-039479

(51) Int. Cl.
*G03G 15/14* (2006.01)
*B41J 2/41* (2006.01)

(52) U.S. Cl. ..... 399/399; 347/112

(58) Field of Classification Search ..... 347/104, 347/22, 112; 271/297; 399/310, 399, 397, 399/49, 353, 13
See application file for complete search history.

(56) References Cited

U.S. PATENT DOCUMENTS 4,349,190 A * 9/1982 Kaneko et al. ..... 271/297
5,086,318 A 2/1992 Takeda et al.
5,515,146 A * 5/1996 Harasawa et al. ..... 399/310
6,085,064 A * 7/2000 Nagase et al. ..... 399/399
6,347,214 B1 * 2/2002 Kaneko ..... 399/397
6,895,209 B2 * 5/2005 Kawahara et al. ..... 399/353
2002/0126193 A1 * 9/2002 Maki et al. ..... 347/104
2005/0105927 A1 * 5/2005 Kayahara ..... 399/49
2006/0050104 A1 * 3/2006 Sakakitani ..... 347/22
2006/0072929 A1 * 4/2006 Takahashi ..... 399/13

FOREIGN PATENT DOCUMENTS

JP 4-128859 4/1992
JP 2607117 2/1997
JP 9-221242 8/1997
JP 9-222801 8/1997
JP 9-222805 8/1997
JP 10-161436 6/1998
JP 10-166563 6/1998
JP 2004-168500 6/2004
JP 2004-175490 6/2004
JP 2004-182392 7/2004
WO WO2004048240 * 6/2004

* cited by examiner

*Primary Examiner*—Stephen D Meier
*Assistant Examiner*—Carlos A Martinez, Jr.
(74) *Attorney, Agent, or Firm*—Cooper & Dunham, LLP

(57) ABSTRACT

An electrostatic attraction device is disclosed that attracts and transports a recording medium by applying an electric field to a surface of an endless belt member with use of a charger while rotating the belt member. The electrostatic attraction device comprises a separation claw holding unit separately provided from the charger.

17 Claims, 11 Drawing Sheets

ELECTROSTATIC ATTRACTION DEVICE AND IMAGE FORMING APPARATUS USING THE SAME

BACKGROUND

1. Technical Field

This disclosure relates to an electrostatic attraction device that attracts and transports recording media, such as paper, and an image forming apparatus, such as an inkjet recording apparatus, using the same.

2. Description of the Related Art

There have been known electrostatic attraction devices that attract and transport recording media, e.g., paper, by applying electric fields to the surfaces of endless charging belts while rotating the belts. There have also been known image forming apparatuses, e.g., inkjet recording apparatuses, using such electrostatic attraction deices. These devices and apparatuses have disadvantages related to cleaning, and various approaches have been proposed to overcome the disadvantages.

[Patent Document 1] Japanese Patent Laid-Open Publication No. 2004-168500

[Patent Document 2] Japanese Patent Laid-Open Publication No. 09-222801

[Patent Document 3] Japanese Patent Laid-Open Publication No. 10-161436

[Patent Document 4] Japanese Patent Laid-Open Publication No. 04-128859

[Patent Document 5] Japanese Patent Laid-Open Publication No. 09-222805

Various efforts have been made to make many of the component parts of theses image forming apparatuses replaceable in order to extend the lives of the apparatuses significantly, for example, by ten times. In connection with this, there has appeared a need for making attraction belts of the electrostatic attraction devices replaceable.

In the meantime, the extended lives of the apparatuses cause a problem in that cleaning mylars (the term "cleaning mylar" as used herein represents a cleaning unit made of Mylar (trademark)) and cleaning brushes for cleaning the charging belt of the electrostatic attraction devices lose the cleaning capacity due to accumulated paper powder and the like. This problem has resulted in a need for enabling replacement of the cleaning mylars and cleaning brushes.

In the related art, since removal of only the charging belt is not considered in design, the whole electrostatic attraction device is removed from the apparatus main body of the image forming apparatus to perform replacement operations as described above. In many image forming apparatuses, such as inkjet recording apparatuses using electrostatic attraction devices, carriage rods provided for supporting carriages impede easy removal of the electrostatic attraction devices. The removal would be easier if the electrostatic attraction devices could be divided into separate units. The electrostatic attraction devices, however, have not been so designed.

To make the removal of the charging belts easier, the electrostatic attraction devices are preferably improved such that separation claws are removable from main bodies of the electrostatic attraction devices. In addition to making the separation claws removable, it is preferable that the electrostatic attraction devices be improved so as to meet the need for removing and replacing consumable parts such as cleaning mylars and cleaning brushes (the term "consumable part" as used herein represents a component part that requires periodic cleaning as well as a consumable part).

BRIEF SUMMARY

The present invention may solve at least one problem described above. A preferred embodiment of the present invention may improve the In an aspect of this disclosure, an electrostatic attraction device is provided in an image forming apparatus whereby efficiency can be attained in replacement and cleaning operations by not only facilitating removal of a charging belt but also allowing integral removal of consumable parts such as cleaning mylars and cleaning brushes.

In an exemplary embodiment of this disclosure, there is provided an electrostatic attraction device that attracts and transports a recording medium by applying an electric field to a surface of an endless belt member with use of a charger while rotating the belt member, the electrostatic attraction device comprising a separation claw holding unit separately provided from the charger.

DETAILED DESCRIPTION OF THE PREFERRED EMBODIMENT

The following description provides exemplarily embodiments of the present invention with reference to the accompanying drawings.

First Embodiment

Figure 1:
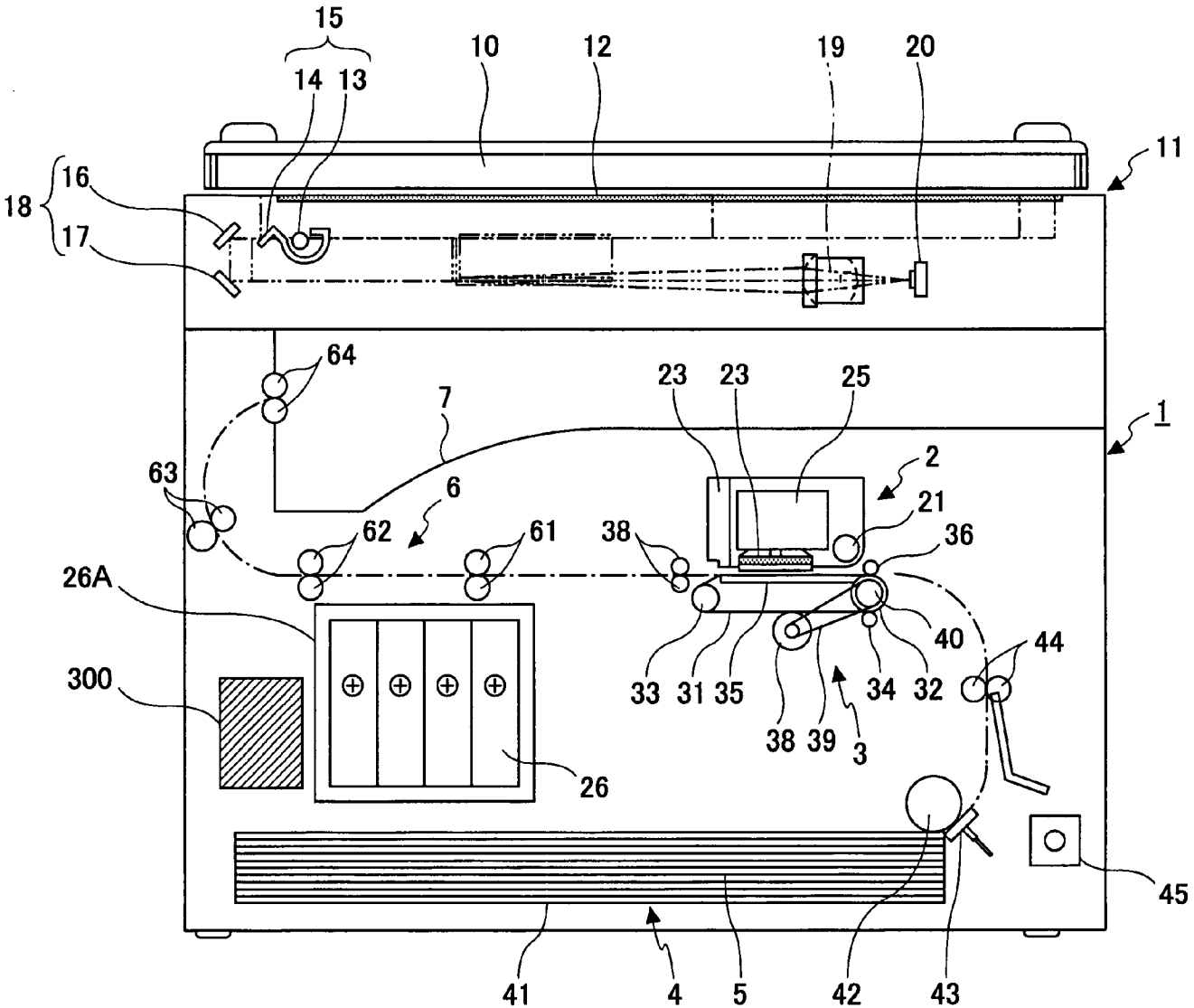
FIG. 1 is a schematic diagram illustrating an inkjet printer as an example of an image forming apparatus according to a first embodiment of the present invention.
Figure 2:
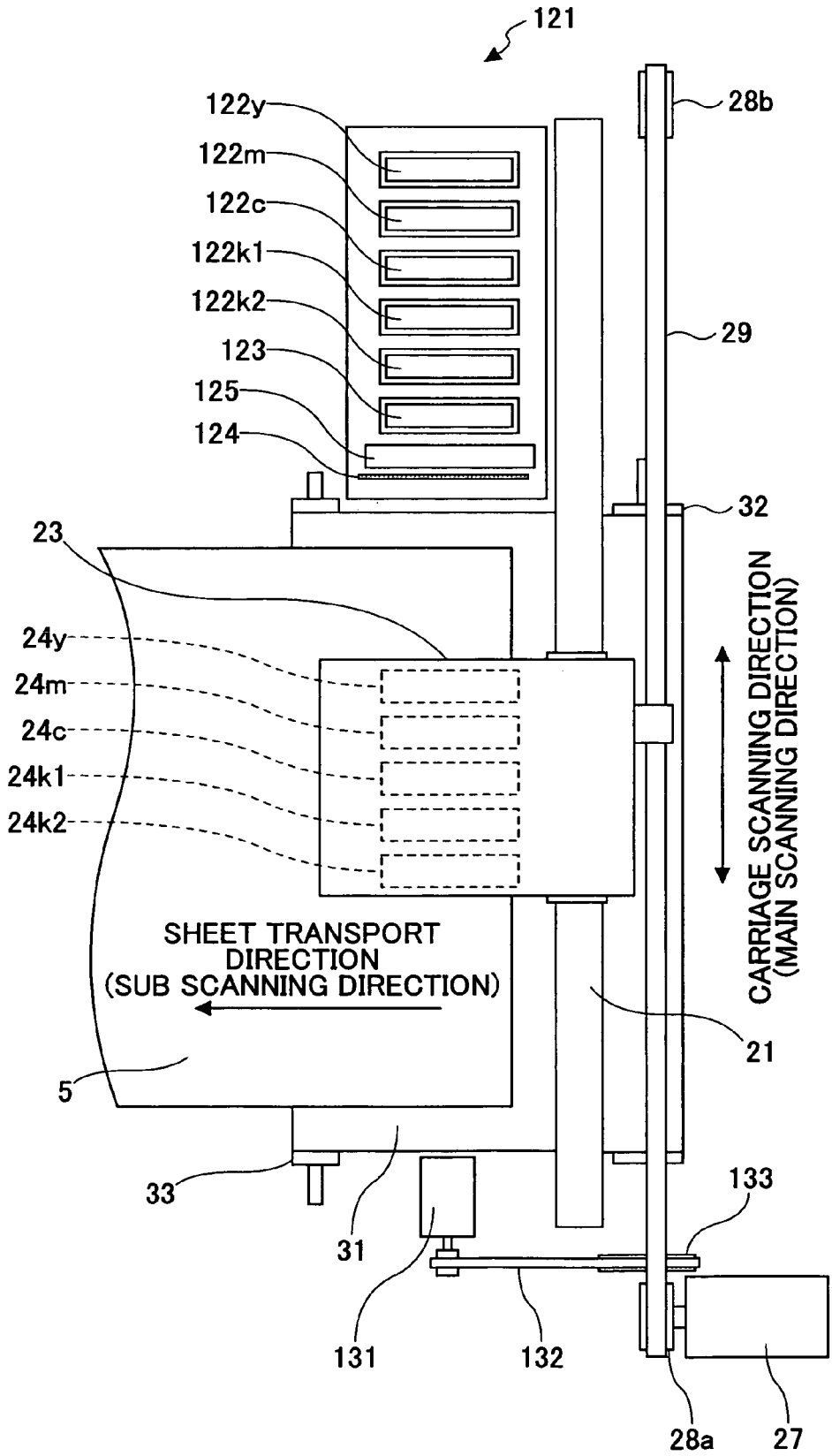
FIG. 2 is a schematic diagram illustrating an image forming section and a sub scanning transport section of the image forming apparatus of FIG. 1.

FIG. 1 is schematic diagram illustrating the configuration of an inkjet printer as an example of an image forming apparatus. FIG. 2 is a schematic diagram illustrating an image forming section 2 and a sub scanning transport section 3 of the image forming apparatus.

This image forming apparatus comprises the image forming section 2 for forming images and the sub scanning transport section 3, etc., inside an apparatus main body (casing) 1. A sheet feed section 4 disposed at the bottom of the apparatus main body 1 feeds a medium 5 to be recorded on (hereinafter referred to as "sheet 5", which may be made of paper or other materials), i.e., a member to be transported, one at a time. The sheet 5 is intermittently transported by the sub scanning transport section 3 while facing the image forming section 2. The image forming section 2 ejects droplets to form (record) images on the sheet 5. The sheet 5 is then ejected onto a catch tray 7 provided on an upper face of the apparatus main body 1 through a sheet eject transport section 6.

The image forming apparatus further comprises an image reading section (scanner section) 11 for scanning images, which is disposed at the upper part of the apparatus main body 1 above the upper side of the catch tray 7. The image reading section 11 reads image data (print data) to be formed by the image forming section 2. In the image reading section 11, images of a document placed on a contact glass 12 are scanned by moving a scanning optical system 15 including an illumination light source 13 and a mirror 14 and another scanning optical system 18 including mirrors 16 and 17. The scanned images are read as image signals by an image reading element 20 disposed at the rear side of a lens 19. The image signals are digitized and processed such that resulting print data can be printed out. A pressure plate 10 for fixing the document is provided on the contact glass 12.

The image forming apparatus may receive print data, including image data, through a cable or a network from host devices, e.g., information processing devices such as personal computers, image reading devices such as image scanners, and imaging devices such as digital cameras. The image forming apparatus may also process the received print data to print them out.

Referring to FIG. 2, in the image forming section 2 of the image forming apparatus, a guide rod 21 and a guide stay (not shown) movably support a carriage 23 such that the carriage 23 can be moved in a main scanning direction by a main scanning motor 27 through a timing belt 29 extending around a drive pulley 28*a* and a driven pulley 28*b*.

The image forming section 2 is a shuttle type. Specifically, while the carriage 23 is reciprocally moved in the main scanning direction, a recording head 24 mounted on the carriage 23 ejects color droplets so as to form images on the sheet 5 being transported intermittently in a sheet transport direction (sub scanning direction) by the sub scanning transport section 3.

The recording head 24 comprises five inkjet heads, i.e., two inkjet heads 24*k*1 and 24*k*2 for ejecting a black (Bk) ink, and inkjet heads 24*c*, 24*m*, and 24*y* for ejecting a cyan (C) ink, a magenta (M) ink, and a yellow (Y) ink, respectively (hereinafter the inkjet heads are referred to as simply "heads"). The inks are supplied from corresponding sub tanks 25 (FIG. 1) mounted on the carriage 23.

Referring back to FIG. 1, ink cartridges 26 storing the black (K) ink, the cyan (C) ink, the magenta (M) ink, and the yellow (Y) ink, respectively, are detachably attached to a cartridge mount section 26A from the front side of the apparatus main body 1. The inks in the ink cartridges 26 are supplied to the corresponding sub tanks 25. The black ink is supplied from one of the ink cartridges 26 to the two of the sub tanks 25.

The recording head 24 is provided with a pressure generating unit (actuator unit) that applies pressure to ink in an ink passage. The pressure generating unit may be a piezo type that deforms a wall of the ink passage, changes the volume of the ink passage, and thus ejects ink droplets; a thermal type that heats ink in an ink passage with use a heating element so as to form bubbles, and ejects the ink with pressure generated due to the formation of the bubbles; and an electrostatic type that provides a diaphragm on a wall of an ink passage and an electrode opposing the diaphragm, deforms the diaphragm with static electricity generated between the diaphragm and the electrode, changes the volume of the ink passage, and thus ejects ink droplets.

With reference to FIG. 2, a maintenance recovery mechanism 121, including a head cleaning unit for maintaining and restoring the condition of nozzles of the recording head 24, is provided in a non-printing area located at one side in a scanning direction of the carriage 23. The maintenance recovery mechanism 121 comprises five dry-proof caps 122*k*2, 122*k*1, 122*c*, 122*m* and 122*y* (which are referred to as "dry-proof caps 122" if not distinguished by the colors thereof) for capping nozzle faces of the recording head 24, a suction cap 123, a wiper blade 124 for wiping the nozzle faces of the recording head 24, and an idle ejection receiver 125 for idle ejection.

Figure 3:
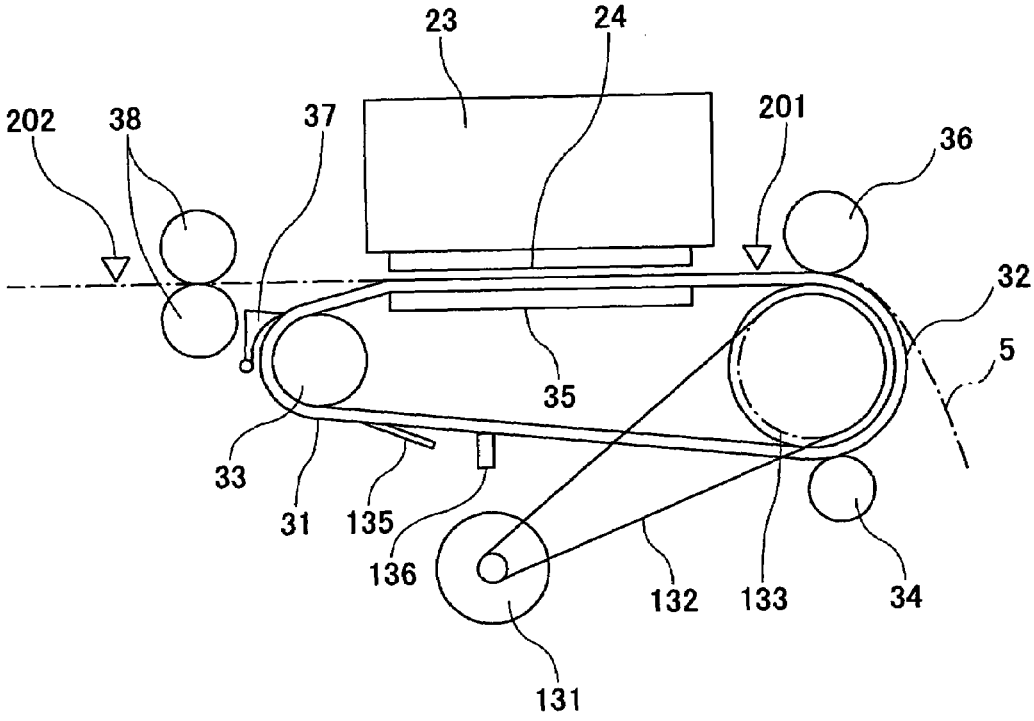
FIG. 3 is an enlarged view of a part of the sub scanning transport section shown in FIGS. 1 and 2.

FIG. 3 is an enlarged view of a part of the sub scanning transport section 3 for use in the image forming apparatus shown in FIGS. 1 and 2. The sub scanning transport section 3 comprises a transport roller 32 as a drive roller for changing a transport direction of the sheet 5 sent from the lower side by 90 degrees such that the sheet 5 faces the image forming section 2, a driven roller 33 as an tension roller, an endless transport belt 31 extending around the transport roller 32 and the driven roller 33, a charging roller 34 as a charger that charges the surface of the transport belt 31 with a high voltage (alternating current) applied from a high-voltage power supply, a guide member 35 that guides the transport belt 31 within an area opposing the image forming section 2, a pressure roller 36 that presses the sheet 5 against the transport belt 31 at a position opposing the transport roller 32, separation claws 37 that separate the sheet 5 on which images are formed from the transport belt 31, and transport rollers 38 that send the sheet 5 separated from the transport belt 31 to the sheet eject transport section 6.

The transport belt 31 of the sub scanning transport section 3 is rotated to transport the sheet 5 in the sheet transport direction (sub scanning direction) indicated by the single-headed arrow shown in FIG. 2 when the transport roller 32 is rotated through a timing belt 132 and a timing roller 133 by a sub scanning motor 131. The transport belt 31 may have a double layer structure including a front layer (sheet attracting face) and a back layer (intermediate resistance layer, grounding layer). For example, the front layer is made of a pure resin material, such as ETFE pure material, and is not subjected to resistance control. The back layer is made of the same material as the front layer but is subjected to resistance control using carbon.

A cleaning unit 135 for removing paper powder and the like adhered to the surface of the transport belt 31 and a discharging brush 136 for discharging the surface of the transport belt 31 are provided between; the driven roller 33 and the charging roller 34. The cleaning unit 135 used in the illustrated embodiment is made of Mylar (trademark), and is hereinafter referred to as "cleaning mylar 135".

The sheet feed section 4, which is removably installed in the apparatus main body 1, comprises a sheet cassette 41 in which the sheets 5 are stacked and stored, a sheet feed roller 42 and a friction pad 43 for sending the sheets 5 stored in the sheet cassette 41 one by one, and a pair of sheet feed transport rollers 44 for transporting the sheet 5 to the sub scanning transport section 3. A sheet feed motor (drive source) 45 including an HB stepping motor rotates the sheet feed roller 42 through a sheet feed clutch (not shown). The sheet feed motor 45 also rotates the sheet feed transport roller 44.

The sheet eject transport section 6 comprises sheet eject transport roller pairs 61 and 62 for transporting the sheet 5 on which images are formed, and a sheet eject transport roller pair 63 and an eject roller pair 64 for sending the sheet 5 to the catch tray 7.

Figure 4:
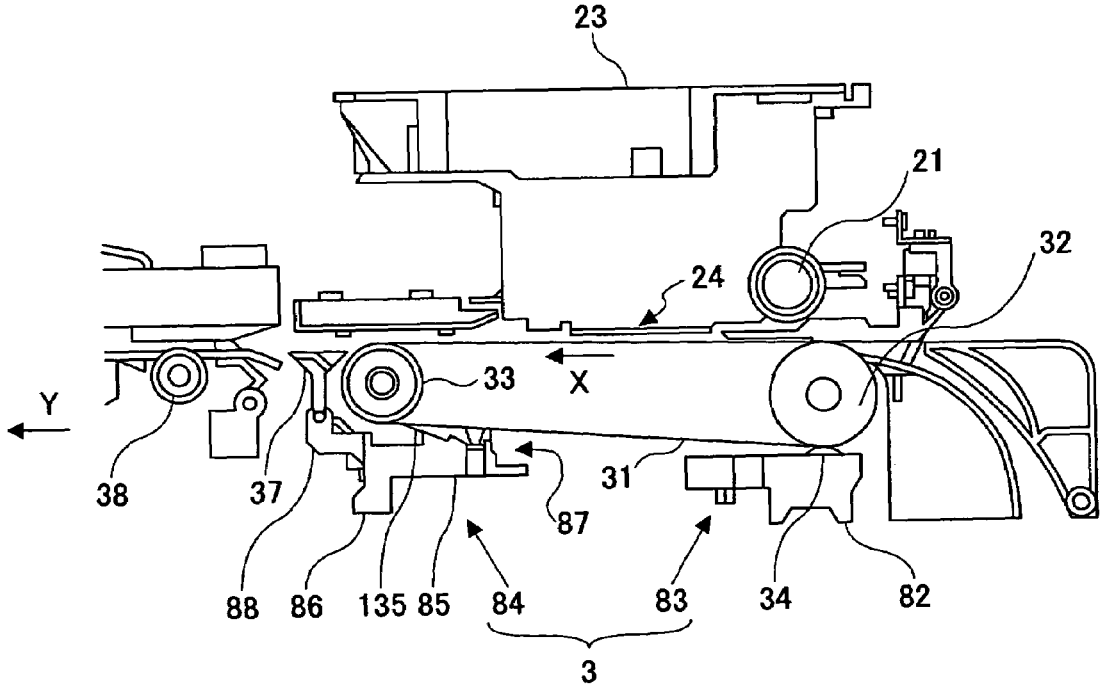
FIG. 4 is a cross-sectional side view illustrating an example of the sub scanning transport section shown in FIGS. 1 and 3, i.e., a recording paper transport device, provided as a separate unit.
Figure 5:
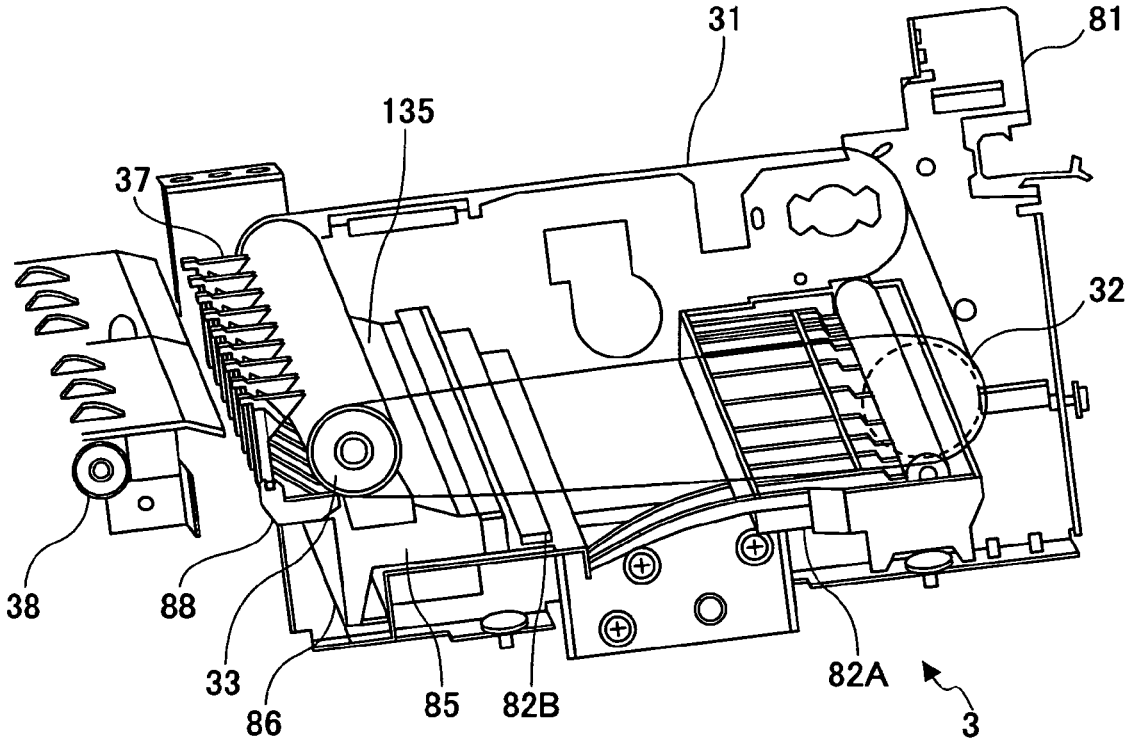
FIG. 5 is a perspective view of a part of FIG. 4.

FIG. 4 is a cross-sectional side view illustrating a configuration example of the sub scanning transport section 3 shown in FIGS. 1 and 3, i.e., a recording paper transport device for use in the illustrated inkjet printer, provided as a separate unit. FIG. 5 is a perspective view showing a part of FIG. 4, wherein elements identical to those in FIGS. 1-3 are identified by the identical reference numbers. It is understood that some components shown in FIG. 3 are not shown in FIG. 5.

The sub scanning transport section 3, which forms an electrostatic attraction device, is provided as a separate unit that can be detachably attached to the apparatus main body 1 of the inkjet printer. More specifically, the sub scanning transport section 3 comprises a charging unit 83, and a separation claw holding unit 84 that is formed separately from the charging unit 83 and can be detachably attached to the charging unit 83. The charging unit 83 includes the charging roller 34 mounted on one of support members 82, i.e., a support member 82A, and adapted to charge the transport belt 31 extending around a pair of rollers (the driven roller 33 and the transport roller 32) whose shafts are supported by the side plates 81. The support members 82 (82A and 82B) are attached to side plates 81 (only one of which is shown in FIG. 5).

The separation claw holding unit 84 is attached to the charging unit 83 with use of the support member 82B disposed near the driven roller 33. The separation claw holding unit 84 comprises a holding base 87 and a separation claw holder 88. The holding base 87 includes a plate base section 85 whose movement on the support member 82B is guided while the separation claw holding unit 84 is moved to be attached to the charging unit 83, and a stopper section 86 extending vertically downward from the end of the base section 85 near the driven roller 33. The separation claw holder 88 is disposed at the outer side of the driven roller 33 and includes the separation claws 37 that separate recording paper attracted and transported by the transport belt 31.

Figure 6:
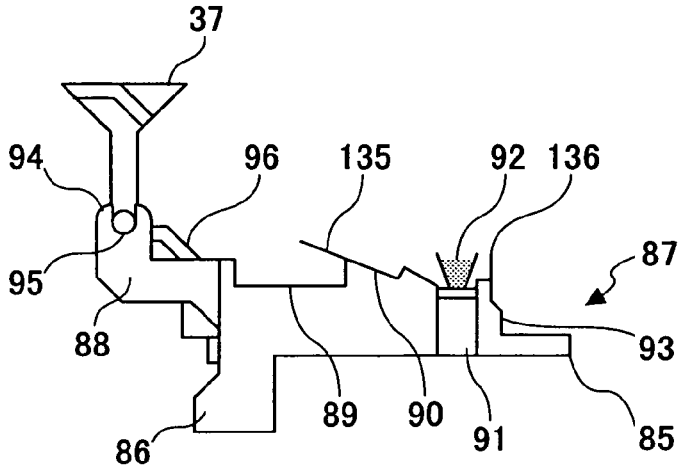
FIG. 6 is an enlarged side view of a part of FIG. 4.

Referring to FIG. 6, the base section 85 has a recess 89 that is located under the driven roller 33 when the separation claw holding unit 84 is in a position attached to the charging unit 83, and a slant face 90 disposed at the transport roller 32 side of the recess 89. The slant face 90 is inclined upward from the transport roller 32 side toward the driven roller 33. The cleaning mylar 135 for cleaning the belt surface is attached to the slant face 90. Therefore, the cleaning mylar 135 slidably contacts the transport belt 31 in the counter direction with respect to a transport direction (indicated by the arrow X of FIG. 4) of the transport belt 31 and in the trailing direction with respect to the direction (indicated by the arrow Y of FIG. 4) of removing the separation claw holding unit 84. Because the cleaning mylar 135 slidably contacts the transport belt 31 in the counter direction, the transport belt 31 is efficiently cleaned.

A recessed groove 91 is formed at the transport roller 32 side of the slant face 90 in the base section 85, in which a cleaning brush 92 for cleaning the surface of the transport belt 31 is disposed. A stepped part 93 is formed at the transport roller 32 side of the recessed groove 91 in the base section 85. The discharging brush 136 is disposed along the surface of the stepped part 93 at the transport roller 32 side.

The configuration and effects of the cleaning mylar 135, the cleaning brush 92, and the discharging brush 136 are known in the art and are not described herein. It should be understood that the cleaning mylar 135, the cleaning brush 92, and the discharging brush 136 are not limited to the configurations illustrated in the drawings, and may have other configurations.

The stopper section 86 contacts an end section of the support member 82B to prevent the separation claw holding unit 84 from advancing beyond a predetermined position when the separation claw holding unit 84 is slid in the direction opposite to the arrow Y to be attached to the charging unit 83. The components of the separation claw holding unit 84 are separately formed on a functional basis so as to improve the efficiency of replacement described below in accordance with the mounting configuration.

The separation claw holder 88 has L-shaped sections for holding the corresponding separation claws 37, and includes plural components. The separation claw holder 88 is connected to an end portion of the base section 85 and is placed at the immediately outer side of the driven roller 33 in the removal direction (Y). A groove 94 having a U-shape with an upper side opened for rotatably supporting the corresponding separation claw 37 is formed in the separation claw holder 88. A shaft 95 provided on a lower end of each separation claw 37 is fitted in the groove 94.

A plate spring 96 is connected to the shaft 95 of each separation claw 37 so as to apply a biasing force that prevents the separation claw 37 from rotating toward the transport belt 31 and contacting the surface of the transport belt 31 due to the own weight of the separation claw 37. It should be understood that the shape of the separation claw 37 described herein is merely an example. Further, a coil spring or other biasing element may be used for preventing the rotation of the separation claw 37 in place of the plate spring 96. In view of extending the life of the transport belt 31, it is preferable that the separation claw 37 apply no or little pressure to the transport belt 31 by preventing the rotation of the separation claw 37 toward the transport belt 31 due to the own weight of the separation claw 37.

The separation claw holding unit 84 can be removed from the image forming apparatus such as the inkjet recording apparatus in the following manner. A unit including the transport rollers 38 is removed or moved to not impede the removal of the separation claw holding unit 84. Then, the separation claw holding unit 84 is removed in the direction of the arrow Y while the base section 85 of the separation claw holding unit 84 is slid on the support member 82B. In the case where the separation claw holding unit 84 is fixed to the support member 82B with screws and the like, the screws are removed before removing the separation claw holding unit 84.

Once the separation claw holding unit 84 is removed, the transport belt 31 can be readily and easily removed by removing minimum component parts necessary to be removed. Consumable parts mounted on the separation claw holding unit 84, such as cleaning mylar 135 disposed on the base section 85, are easily replaced without removing the transport belt 31. Not only the cleaning mylar 135 but also other consumable parts are replaced independently. Therefore, only the desired consumable parts can be replaced so as to eliminate waste. The separation claw holding unit 84 is mounted by performing the reverse operations described above.

Figure 7:
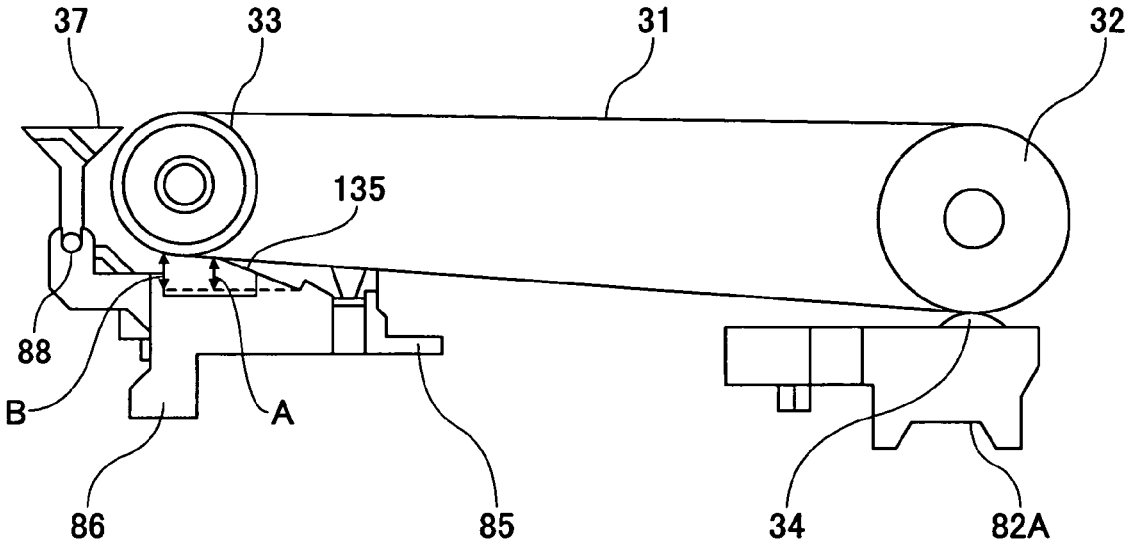
FIG. 7 shows an example of the distance between a base end of a cleaning mylar and a transport belt as a charging belt.
Figure 8:
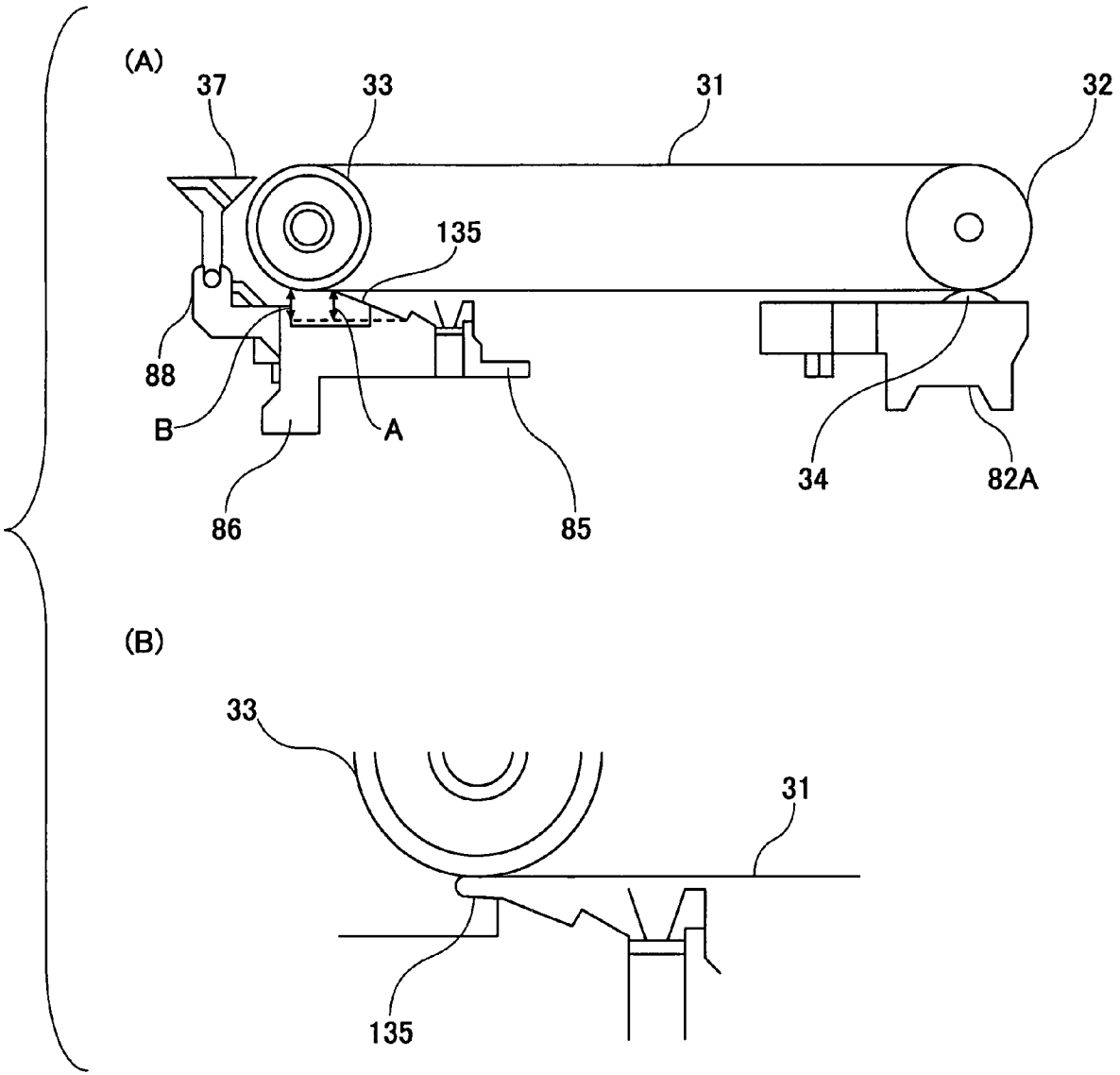
FIGS. 8A and 8B show a comparative example of the distance between a base end of a cleaning mylar and a transport belt.

In the illustrated embodiment, as best shown in FIG. 7, the driven roller 33 has a smaller diameter than the transport roller 32. The lower side of the transport roller 32 is located lower than the lower side of driven roller 33. That is, the transport belt 31 is inclined at the lower side of the rollers 32 and 33. Therefore, with reference to FIG. 7, a distance A between the transport belt 31 and a base end of the cleaning mylar 135 when the separation claw holding unit 84 is located in its attached position is slightly less than a distance B (i.e., A<B) between the transport belt 31 and the base end of the cleaning mylar 135 immediately before when the separation claw holding unit 84 is located to be removed, due to the downward inclination of the transport belt 31. With this configuration, the tip end the cleaning mylar 135, which slidably contacts transport belt 31 in the counter direction, is prevented from being bent due to contact with the transport belt 31 during removal of the separation claw holding unit 84. FIG. 8A shows a comparative example in which the driven roller 33 and the transport roller 32 have the same diameter and the transport belt 31 runs horizontally at both the upper side and lower side of the rollers 32 and 33. In this comparative example, the distance A is equal to the distance B (i.e., A=B). Accordingly, the distance between the cleaning mylar 135 and the lower surface of the transport belt 31 remains constant and therefore a constant friction force is applied during the removal of the separation claw holding unit 84. As a result, the cleaning mylar 135 is likely to be bent, especially at the tip end, as shown in FIG. 8B.

According to the first embodiment of the present invention, since the driven roller 33 has the smaller diameter than the transport roller 32 and the transport belt 31 is horizontal at the upper side of the rollers 32 and 33 and is inclined at the lower side of the rollers 32 and 33, a space for installing the separation claw holding unit 84 is created under the driven roller 33. Accordingly, the positional relationship between the transport belt 31 and the separation claw holding unit 84 is simple as best shown in FIG. 7.

The following description is related to another disadvantage of electrostatic attraction devices that attract and transport recording media, e.g., paper, by applying electric fields to the surfaces of endless transport belts while rotating the belts. The disadvantage is that a sheet fails to be separated from the belt and get jammed.

[Patent Document 6] Japanese Patent Laid-Open Publication No. 2004-175490

[Patent Document 7] Japanese Patent Laid-Open Publication No. 10-166563

To eliminate this problem, devices including separation claws disposed at belt separation sections have been proposed (see, for example, Patent Documents 6 and 7). Generally, a separation claw includes claw sections aligned in a width direction of a wide belt, which slidably contact the belt surface so as to separate a sheet attracted across its surface on the belt surface. The separation claw applying greater contact pressure to the belt can more surely contact the belt and perform sheet separation.

On the other hand, because the life of the belt becomes shorter as the contact pressure becomes greater, it is preferable to reduce the contact pressure of the separation claw applied to the belt. However, the separation claw having smaller contact pressure is more likely to have a variation in the contact position and contact angle, so that some claw sections might be brought out of contact with the belt surface. Having claw sections out of contact with the belt surface might prevent separation of the sheet and cause a paper jam.

According to an aspect of the present invention, there is provided an electrostatic attraction device and an image forming apparatus, capable of surely separating a sheet while a separation claw maintains contact with a belt surface.

According to another aspect of the present invention, there is provided an electrostatic attraction device that attracts and transports a recording medium by applying an electric field to a surface of an endless belt member with use of a charger while rotating the belt member, the electrostatic attraction device comprising a separation claw detachably disposed downstream of a direction of transporting the recording medium and adapted to separate the recording medium from the belt member.

Second Embodiment

Figure 9:
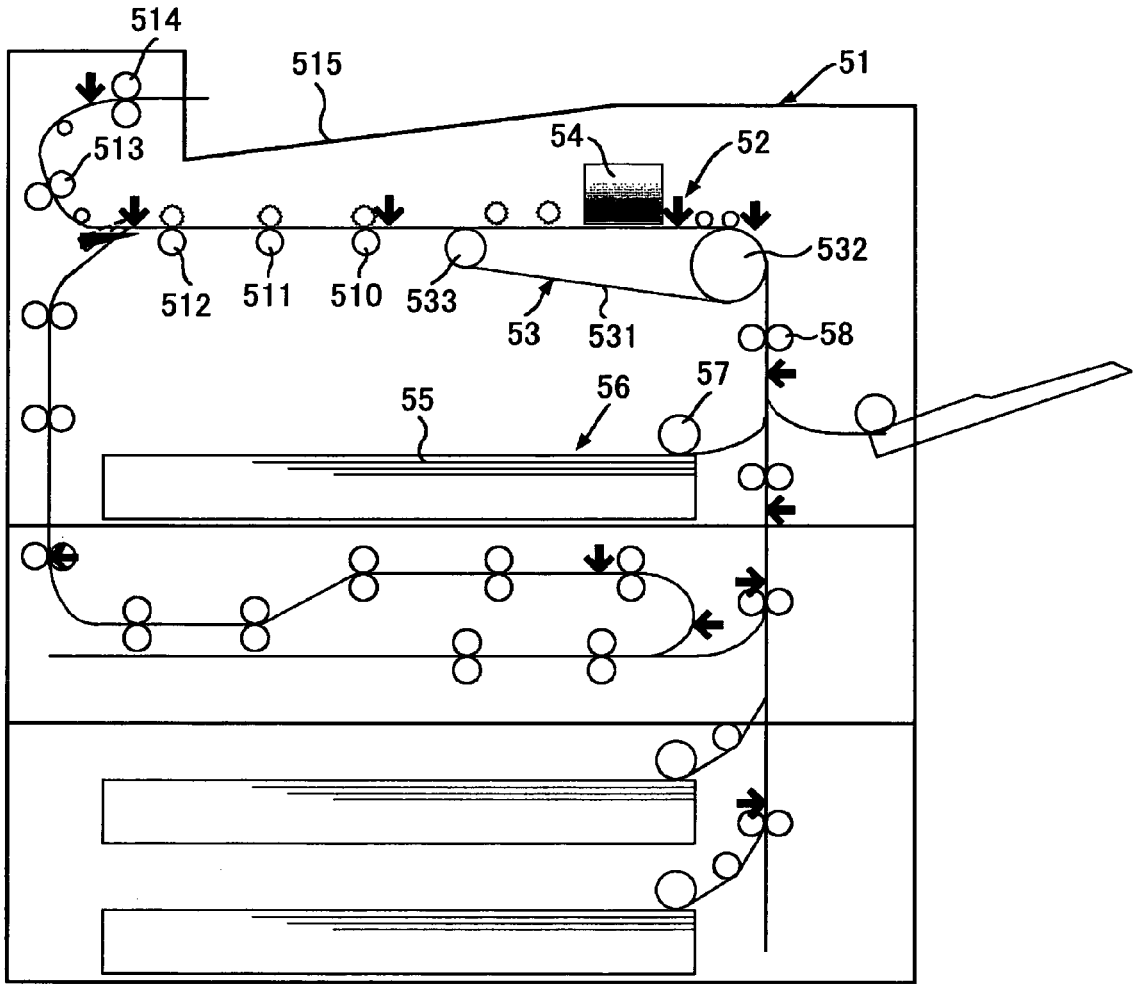
FIG. 9 is a schematic diagram illustrating an inkjet recording apparatus as an example of an image forming apparatus according to a second embodiment of the present invention.

FIG. 9 is a schematic diagram illustrating an inkjet recording apparatus as an example of an image forming apparatus according to one embodiment of the present invention.

The image forming apparatus comprises, inside an apparatus main body 51 and an image forming section 52 for forming images. The image forming section 52 includes a transport belt device 53 for transporting a recording medium 55 to be recorded on (hereinafter referred to as "sheet 55") in a sub scanning direction, and a recording head 54 for forming images on the sheet 55. The recording head 54 of this embodiment comprises at least four line-type inkjet heads (not shown) that are aligned in a direction of transporting the sheet 55 and eject droplets of different colors. The recording head 54 is a shuttle type head. Specifically, while a carriage (not shown) on which the recording head 54 is mounted is reciprocally moved in a main scanning direction, the recording head 54 ejects color droplets so as to form images on the sheet 55 being intermittently transported in the sheet transport direction (sub scanning direction). The recording head 54 is provided with a pressure generating unit (actuator unit) that applies pressure to ink in an ink passage. The pressure generating unit may be a piezo type that deforms a wall of the ink passage, changes the volume of the ink passage, and thus ejects ink droplets; a thermal type that heats ink in an ink passage with use a heating element so as to form bubbles, and ejects the ink with pressure generated due to the formation of the bubbles; and an electrostatic type that provides a diaphragm on a wall of an ink passage and an electrode opposing the diaphragm, deforms the diaphragm with static electricity generated between the diaphragm and the electrode, changes the volume of the ink passage, and thus ejects ink droplets.

The following describes the flow of the sheet 55 during formation of images.

A main body sheet feed section 56 is disposed at the lower side of the image forming section 52 of the apparatus main body 51. When a sheet feed roller 57 of the main body sheet feed section 56 is operated, the sheets 55 are sent one by one from the main body sheet feed section 56 through a multi feed prevention unit (not shown). The sheet 55 is then brought into contact with and aligned by a registration roller 58 disposed upstream of the image forming section 52. Then, the sheet 55 is sent to the transport belt device 53. The recording head 54 forms images on the sheet 55 being transported by the transport belt device 53. After the images are formed, the sheet 55 is ejected with the image side down through transport rollers 510-513 and an eject roller 514 to a sheet catch section 515 formed on the upper side of the apparatus main body 51.

Figure 10:
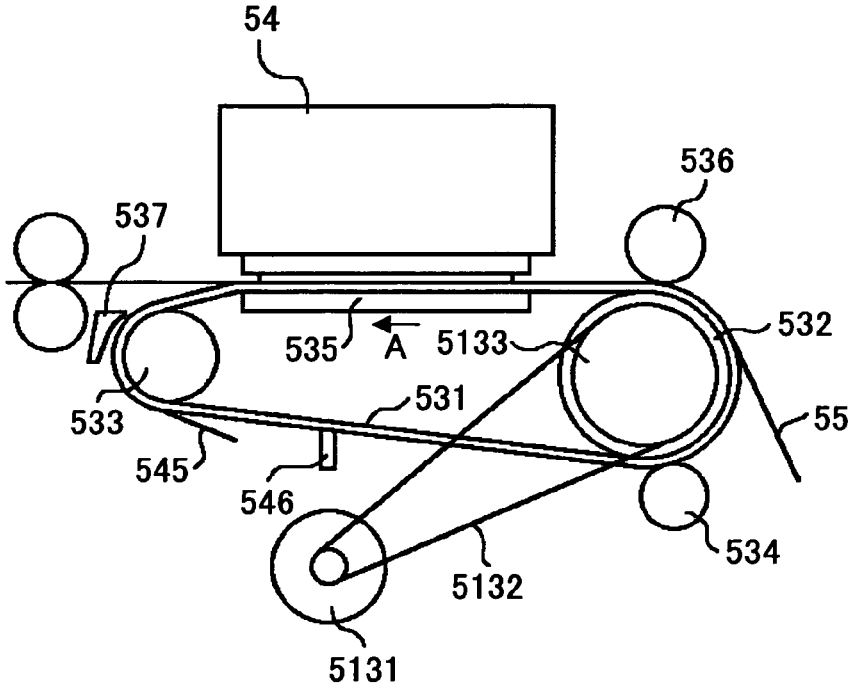
FIG. 10 is an enlarged view showing a transport belt device of the image forming apparatus of FIG. 9.

FIG. 10 is an enlarged view of the transport belt device 53 of the image forming apparatus of FIG. 9.

The transport belt device 53 comprises an endless transport belt 531 extending around a transport roller 532 as a driving roller and a driven roller 533 as a tension roller. The transport roller 532 serves to transport the sheet 55 sent from the lower side in a manner opposed by the recording head 54. The transport belt device 53 further comprises a charging roller 534 as a charger that charges the surface of the transport belt 531 with a high voltage (alternating current) applied from a high-voltage power supply, a guide member 535 that guides the transport belt 531 within an area opposing the recording head 54, a pressure roller 536 that presses the sheet 55 against the transport belt 531 at a position opposing the transport roller 532, and separation claws 537 that separate the sheet 55 on which images are formed by the recording head 54 from the transport belt 531.

Referring to FIG. 10, the transport belt device 53 is configured such that the transport belt 531 is rotated in the direction indicated by the arrow A when the transport roller 532 is rotated through a timing belt 5132 and a timing roller 5133 by a belt motor 5131. The transport belt 531 may have a double layer structure including a front layer (sheet attracting face) and a back layer (intermediate resistance layer, grounding layer). For example, the front layer is made of a pure resin material, such as ETFE pure material, and is not subjected to resistance control. The back layer is made of the same material as the front layer but is subjected to resistance control using carbon.

A cleaning film 545 as a cleaning unit for removing paper powder and the like adhered to the surface of the transport belt 531 and a discharging brush 546 for discharging the surface of the transport belt 531 are provided between the driven roller 533 and the charging roller 534. The cleaning film 545 used in the illustrated embodiment is made of, for example, Mylar (trademark).

Figure 11:
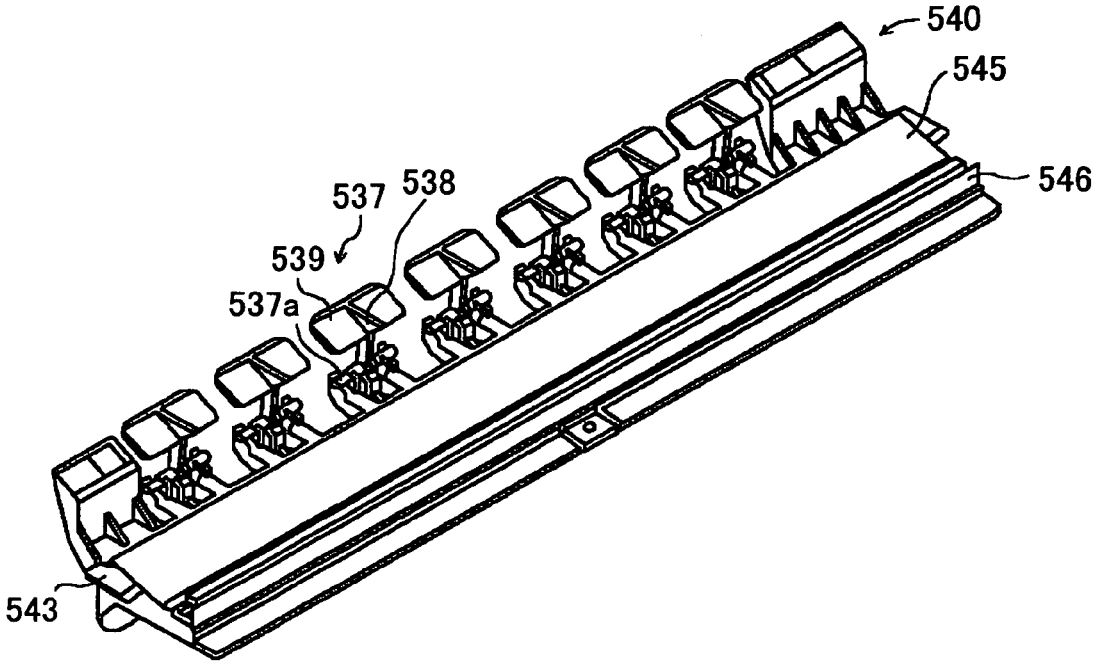
FIG. 11 is a perspective view illustrating a separation claw holding unit.
Figure 12:
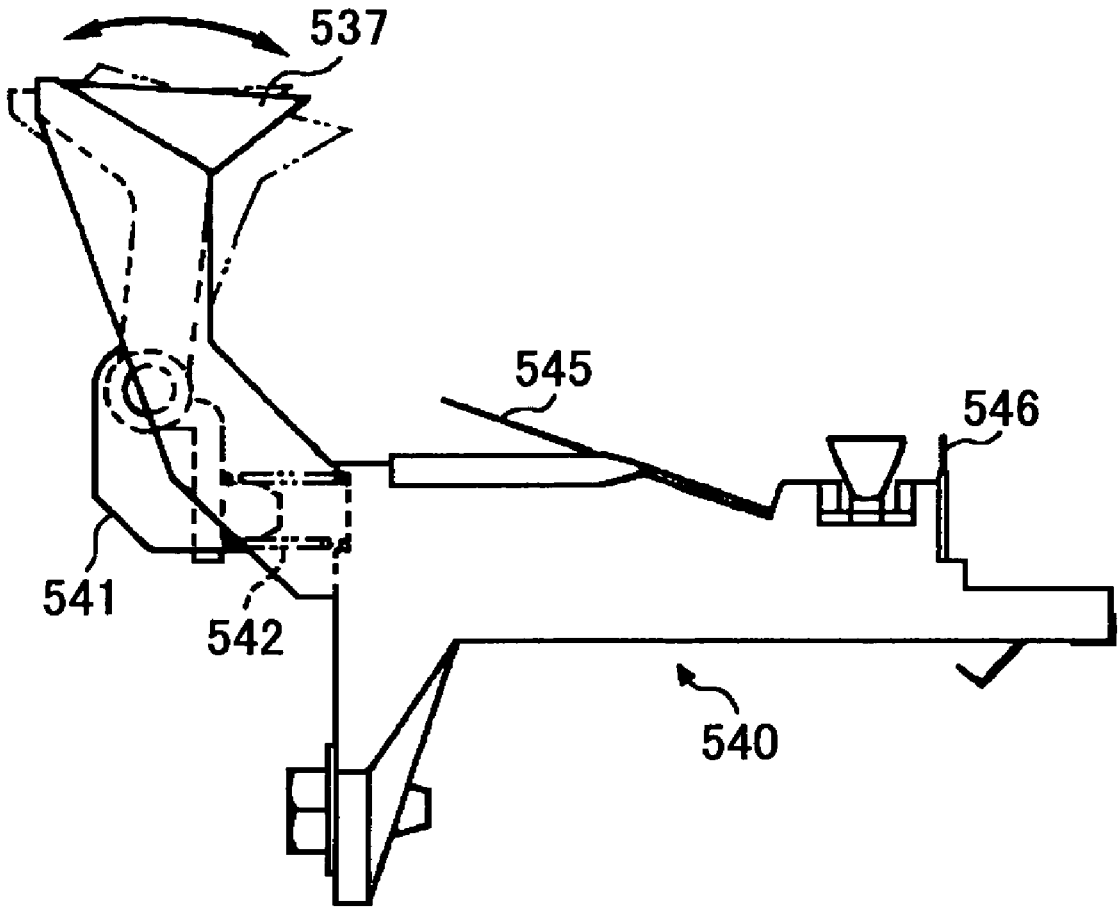
FIG. 12 is a side view illustrating a separation claw holding unit.

As shown in FIG. 11, plural separation claws 537 (seven in this embodiment) are rotatably supported at rotary shafts 537*a* on corresponding support arms 541 of the separation claw holding unit 540. Referring to FIG. 12, springs 542 attached between the support arms 541 and the separation claw holding unit 540 apply force in the clockwise direction of FIG. 12 to rotate the corresponding separation claws 537 about corresponding rotary shafts 537*a* (FIG. 13), thereby applying a sliding pressure to the transport belt 531. Guide blades 539 for guiding the sheet 55 are provided one on each side of a claw section 538 of each separation claw 537. The guide blades 539 guide the separated sheet 55 toward the transport rollers 510-513. In addition to the separation claws 537, the above-mentioned cleaning film 545 and the discharging brush 546 are detachably mounted on the separation claw holding unit 540.

It is preferable that the separation claws 537 apply smaller pressure to the transport belt 531 in view of extending the life of the transport belt 531. However, as mentioned earlier, if the pressure of the separation claws 537 to the transport belt 531 is too small, the separation claws 537 may differ in the contact position and contact angle. Thus, the separation claws 537 may be out of contact with the transport belt 531 and fail to separate the sheet 55.

Figure 13:
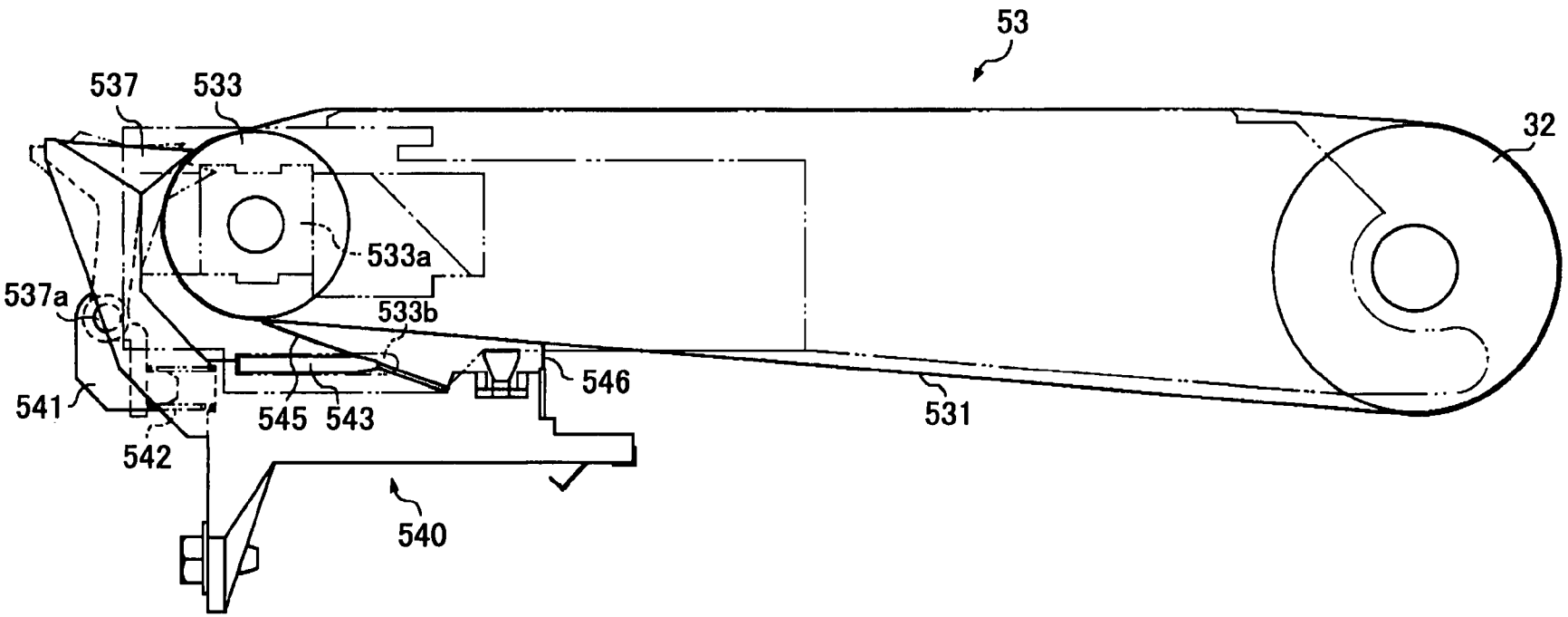
FIG. 13 is a side view illustrating a separation claw holding unit attached to a roller guide.
Figure 14:
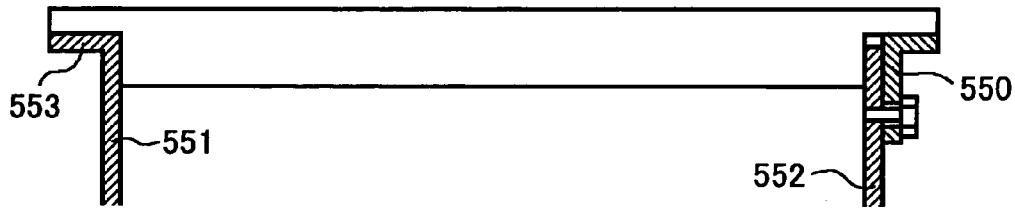
FIG. 14 is a cross-sectional view illustrating a belt adjustment plate.

According to one embodiment of the present invention, the separation claws 537 are substantially positioned relative to the transport belt 531. In the embodiment illustrated in FIGS. 11 and 12, positioning blades 543 are provided one on each side of the separation claw holding unit 540 that supports the separation claws 537. With reference to FIG. 13, each positioning blade 543 is slid into and attached to a receiving section 533*b* formed in a guide plate 533*a* that supports the driven roller 533.

As the separation claw holding unit 540 is positioned relative to the guide plate 533*a*, the contact positions and contact angles of the separation claws 537 can be accurately fixed.

Figure 15:
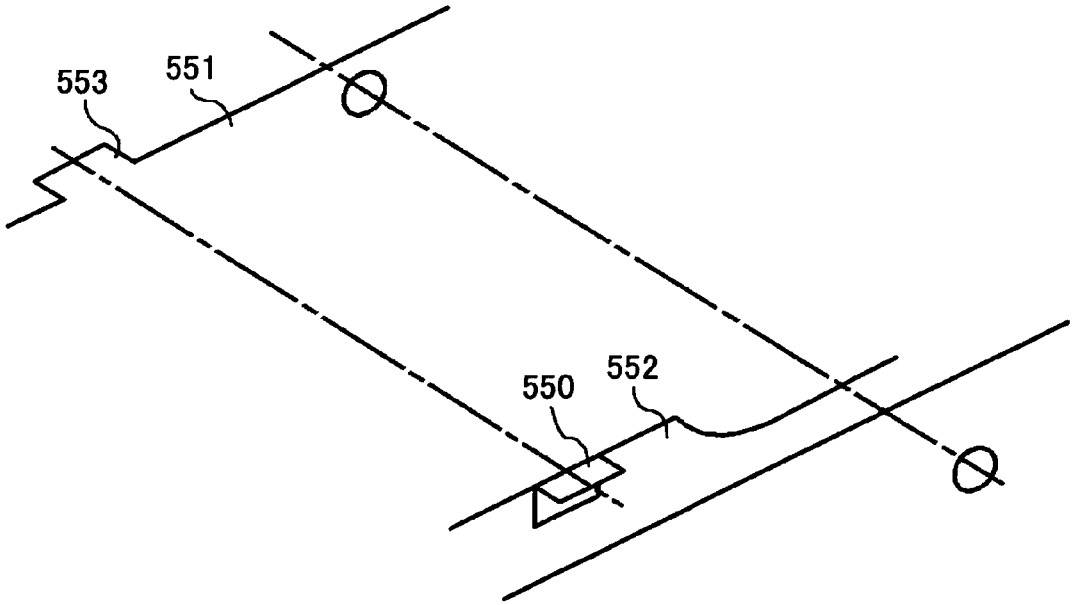
FIG. 15 is a diagram for illustrating effects of a belt adjustment plate.

In an alternative embodiment, the positioning blade 543 can be attached to a receiving section formed on a belt adjustment plate 550 for adjusting the position of the transport belt 531. The separation claws 537 of this alternative embodiment can achieve the same effects as in the above-described embodiment. The belt adjustment plate 550 is briefly described below with reference to FIG. 15. The belt device 53 is supported at four points, on one of which the belt adjustment plate 550 is provided so as to adjust the position of the transport belt 531. Accordingly, the transport belt device 53 can be supported and mounted on frame members, i.e., sub side plates 551 and 552 while maintaining flatness of the transport belt 531. Moreover, the flatness can be reproduced even after removing and replacing the transport belt 531.

In the case where the transport belt device 53 is supported at four points directly fixed to the sub side plates 551 and 552 and the support plate 553, the transport belt device 53 may suffer from swinging and distortion, so that it would be difficult to achieve flatness. If the frame members, i.e., the sub side plates 551 and 552 and the support plate 553 are distorted, the transport belt device 53 is affected by the distortions of the frame members. In such a case, even if the transport belt device 53 is mounted to achieve the flatness in an initial assembly process by using a tool, it is difficult to reproduce the flatness once the transport belt device 53 is removed.

On the other hand, in the case where the transport belt device 53 is mounted at three points directly fixed to the frame members, i.e., the sub side plates 551 and 552 and the support plate 553, the mounted transport belt 531 is prevented from being distorted and swinging. After the transport belt device 53 achieves flatness with the three points fixed, the mount position of the belt adjustment plate 550, whose position is adjustable in accordance with the transport belt device 53, is adjusted so as to support the transport belt device 53. Thus, the transport belt device 53 is prevented from swinging and distortion, and can reproduce the flatness upon reassembly and replacement.

As the separation claw holding unit 540 is mounted on the belt adjustment plate 550 having the configuration as described above, the contact positions and contact angles of the separation claws 537 can be accurately fixed. Further, since the separation claw holding unit 540 is mounted accurately relative to the transport belt 531, the cleaning film 545 and the discharging brush 546 can be placed in the correct positions.

The present application is based on Japanese Priority Application No. 2004-370561 filed on Dec. 22, 2004, and Japanese Priority Application No. 2005-039479 filed on Feb. 16, 2005, with the Japanese Patent Office, the entire contents of which are hereby incorporated by reference.

What is claimed is:

1. An electrostatic attraction device that attracts and transports a recording medium by applying an electric field to a surface of an endless belt member with use of a charger while rotating the belt member, comprising:

a separation claw holding unit separately provided from the charger, wherein the separation claw holding unit includes a separation claw and a consumable part, and wherein the separation claw holding unit comprises a holding base including a first plate section whose movement is guided by an electrostatic attraction device main body including the charger while the separation claw holding unit is moved to an attached position where the separation claw holding unit is attached to the electrostatic attraction device main body, and a second plate section that stops the movement of the first plate section when the separation claw holding unit reaches the attached position.

2. The electrostatic attraction device as claimed in claim 1, wherein the consumable part is removably attached to the separation claw holding unit.

3. The electrostatic attraction device as claimed in claim 1, wherein the consumable part is disposed on the first plate section.

4. The electrostatic attraction device as claimed in claim 1, wherein the consumable part is at least one of a cleaning mylar that cleans the surface of the belt member, a cleaning brush that cleans the surface of the belt member, and a discharging brush that discharges the surface of the belt member.

5. The electrostatic attraction device as claimed in claim 4, wherein the cleaning mylar slidably contacts the belt member in a counter direction with respect to a rotational direction of the belt member and in a trailing direction with respect to a removal direction of the separation claw holding unit.

6. The electrostatic attraction device as claimed in claim 1, wherein the belt member extends around a pair of rollers, and one of the rollers that is located closer to the separation claw holding unit has a smaller roller diameter than the other roller.

7. The electrostatic attraction device as claimed in claim 1, wherein said one of the rollers located closer to the separation claw holding unit is a tension roller, and the other roller is a driving roller.

8. An image forming apparatus comprising;

the electrostatic attraction device of claim 1.

9. An electrostatic attraction device that attracts and transports a recording medium by applying an electric field to a surface of an endless belt member with use of a charger while rotating the belt member, comprising:

a separation claw holding unit having a separation claw detachably disposed downstream in a direction of transporting the recording medium and adapted to separate the recording medium from the belt member; and a consumable part, wherein the separation claw holding unit comprises a holding base including a first plate section whose movement is guided by an electrostatic attraction device main body including the charger while the separation claw holding unit is moved to an attached position where the separation claw holding unit is attached to the electrostatic attraction device main body, and a second plate section that stops the movement of the first plate section when the separation claw holding unit reaches the attached position.

10. The electrostatic attraction device as claimed in claim 9, wherein the separation claw is disposed on a separation claw holding unit, and the separation claw holding unit is positioned and attached relative to the belt member.

11. The electrostatic attraction device as claimed in claim 10, wherein the separation claw holding unit is attached to a platen guide plate of the belt member.

12. The electrostatic attraction device as claimed in claim 10, wherein the separation claw holding unit is attached to a positioning adjustment plate of the belt member.

13. The e1ectrostatic attraction device as claimed in claim 9, wherein the separation claw comprises a plurality of separation claw sections, each separation claw section including a claw section and a guide blade that guides transportation of the separated recording medium.

14. An image forming apparatus comprising:

the electrostatic attraction device of claim 9 and a recording head that forms an image by ejecting a droplet to the recording medium.

15. An image forming apparatus comprising:

the electrostatic attraction device of claim 9.

16. An electrostatic attraction device that attracts and transports a recording medium by applying an electric filed to a surface of an endless belt member with use of a charger while rotating the belt member, comprising:

a separation claw holding unit separately provided from the charger;

a separation claw and a consumable part included by the separation claw holding unit;

the consumable part being at least one of a cleaning mylar that cleans the surface of the belt member and slidably contacts the belt member in a counter direction with respect to a rotational direction of the belt member and in a trailing direction with respect to a removal direction of the separation claw holding unit;

a cleaning brush that cleans the surface of the belt member; and a discharging brush that discharges the surface of the belt member;

wherein a positional relationship between the belt member and the separation claw holding unit satisfies B>A in which A represents a distance between the belt member and the cleaning mylar when the separation claw holding unit is attached to the electrostatic attraction device main body and B represents a distance between the belt member and the cleaning mylar immediately before when the separation claw holding unit is to be removed from the electrostatic device main body.

17. an image forming apparatus comprising

The electrostatic attraction device of claim 16.

* * * * *